US009956449B2

(12) United States Patent
Adams

(10) Patent No.: US 9,956,449 B2
(45) Date of Patent: May 1, 2018

(54) TRAMPOLINE SYSTEMS AND METHODS OF MAKING AND USING THE SAME

(71) Applicant: Arch Luther Adams, Hartwell, GA (US)

(72) Inventor: Arch Luther Adams, Hartwell, GA (US)

( * ) Notice: Subject to any disclaimer, the term of this patent is extended or adjusted under 35 U.S.C. 154(b) by 0 days. days.

(21) Appl. No.: 15/079,114

(22) Filed: Mar. 24, 2016

(65) Prior Publication Data

US 2016/0279457 A1 Sep. 29, 2016

Related U.S. Application Data

(60) Provisional application No. 62/138,469, filed on Mar. 26, 2015.

(51) Int. Cl.
*A63B 17/00* (2006.01)
*A63B 5/11* (2006.01)
(Continued)

(52) U.S. Cl.
CPC ..... *A63B 5/11* (2013.01); *A63B 17/00* (2013.01); *A63B 71/02* (2013.01); *A63B 71/023* (2013.01); *A63C 19/00* (2013.01)

(58) Field of Classification Search
CPC .... A63B 5/00; A63B 5/08; A63B 5/11; A63B 5/16; A63B 2005/085; A63B 6/00; A63B 6/02; A63B 17/00; A63B 17/02; A63B 17/04; A63B 21/00047; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/068; A63B 21/08; A63B 21/4023; A63B 21/4027; A63B 21/4037; A63B 23/035; A63B 23/03508;
(Continued)

(56) References Cited

U.S. PATENT DOCUMENTS 3,233,895 A * 2/1966 Grelle ..... A63B 5/11 182/139
3,837,643 A * 9/1974 Lee ..... A63B 5/11 482/29
(Continued)

FOREIGN PATENT DOCUMENTS

DE 195 35 693 A1 3/1993
EP 1 038 556 A1 9/2000
(Continued)

OTHER PUBLICATIONS

EP 11 16 9904 European Search Report and Written Opinion, dated May 11, 2012.

*Primary Examiner* — Loan H Thanh
*Assistant Examiner* — Gary D Urbiel Goldner
(74) *Attorney, Agent, or Firm* — Withers & Keys, LLC

(57) ABSTRACT

Trampoline systems containing at least one platform that extends over and above adjacent trampoline jumping surfaces is disclosed. Methods of making and using trampoline systems containing at least one platform that extends over and above adjacent trampoline jumping surfaces are also disclosed.

20 Claims, 7 Drawing Sheets

(51) Int. Cl.
*A63B 71/02* (2006.01)
*A63C 19/00* (2006.01)

(58) Field of Classification Search
CPC ..... A63B 23/03516; A63B 23/03525; A63B 23/04; A63B 23/0405; A63B 23/0482; A63B 23/0488; A63B 23/0494; A63B 23/08; A63B 23/10; A63B 2023/0411; A63B 26/00; A63B 26/003; A63B 71/0054; A63B 71/02; A63B 71/023; A63B 71/04; A63B 2071/0063; A63B 2071/0072; A63B 2071/0081; A63B 2071/009; A63B 2208/02; A63B 2208/0204; A63B 2208/0209; A63B 2208/0223; A63B 2209/023; A63B 2225/10; A63B 2225/105; A63B 2225/107; A63B 2244/08; A63B 2244/087; A63B 2244/088
See application file for complete search history.

(56) References Cited

U.S. PATENT DOCUMENTS 4,477,083 A * 10/1984 Sowards ..... A63B 5/11 473/423
5,374,225 A * 12/1994 Wilkinson ..... A63B 5/11 482/114
5,533,948 A * 7/1996 Wilkinson ..... A63B 5/11 482/146
5,593,368 A 1/1997 Checketts
5,607,377 A * 3/1997 Wilkinson ..... A63B 5/11 482/27
5,624,122 A * 4/1997 Winkelhorn ..... A63B 5/11 473/471
5,634,870 A * 6/1997 Wilkinson ..... A63B 5/11 482/27
5,645,510 A * 7/1997 Wilkinson ..... A63B 5/11 482/27
5,674,157 A * 10/1997 Wilkinson ..... A63B 5/11 482/27
5,853,352 A * 12/1998 Login ..... A63B 6/00 482/23
7,832,265 B1 * 11/2010 Gong ..... A63B 67/002 73/147
8,323,154 B1 * 12/2012 Bolillo ..... A63B 5/11 482/27
8,657,696 B1 * 2/2014 Gurley ..... A63B 5/11 472/92
8,668,190 B1 * 3/2014 Heruska ..... A63B 5/11 188/372
8,911,331 B2 * 12/2014 DeBlanco ..... A63B 5/11 482/27
9,192,867 B1 * 11/2015 Sann ..... A63B 17/02
9,295,867 B1 * 3/2016 DeVore ..... A63B 5/11
9,302,135 B1 * 4/2016 Dallmann ..... A63B 5/11
2002/0010042 A1 * 1/2002 Gordon ..... A63B 5/11 473/490
2005/0043142 A1 * 2/2005 Rieber ..... A63B 5/11 482/27
2010/0311545 A1 * 12/2010 Fenn ..... A47C 9/022 482/29
2011/0287899 A1 * 11/2011 West ..... A63B 5/11 482/27
2013/0190137 A1 * 7/2013 Kim ..... A63B 5/11 482/29
2013/0196823 A1 * 8/2013 DeBlanco ..... A63B 5/11 482/27
2014/0005003 A1 * 1/2014 Howell ..... A63B 5/11 482/27
2014/0230154 A1 * 8/2014 Palumbo ..... A63B 6/02 5/706
2016/0096055 A1 * 4/2016 Smock ..... A63B 5/11 482/27

FOREIGN PATENT DOCUMENTS

EP 2535088 A1 * 12/2012 ..... A63B 5/11
FR 2 684 882 A1 6/1993
FR 2 811 901 A1 1/2002
FR 2 844 206 A1 3/2004
GB 1 056 195 A 1/1967
GB 2290561 A * 1/1996 ..... A63B 5/11

* cited by examiner

TRAMPOLINE SYSTEMS AND METHODS OF MAKING AND USING THE SAME

CROSS-REFERENCE TO RELATED APPLICATIONS

This patent application claims the benefit of priority to U.S. Provisional Patent Application Ser. No. 62/138,469 filed on Mar. 26, 2015 and entitled "TRAMPOLINE SYSTEMS AND METHODS OF MAKING AND USING THE SAME," the subject matter of which is hereby incorporated by reference in its entirety.

FIELD OF THE INVENTION

The present invention is directed to trampoline systems. The present invention is further directed to methods of making and using trampoline systems.

BACKGROUND

Efforts continue to further develop trampoline systems.

SUMMARY

The present invention addresses some of the difficulties and problems discussed above by the discovery of new trampoline systems.

Accordingly, the present invention is directed to trampoline systems. In one exemplary embodiment, the trampoline systems of the present invention comprise: at least one trampoline jumping surface with each trampoline jumping surface comprising at least one surface edge that faces the at least one platform; one or more vertically-extending frame members, each of the one or more vertically-extending frame members extending (i) between the at least one surface edge and a support structure frame member of a trampoline support structure, and (ii) a distance $d_{fm}$ above an upper surface of the trampoline jumping surface; and one or more platforms supported by the one or more vertically-extending frame members, each platform having an upper platform surface and a lower platform surface, the lower platform surface being positioned at least a minimum distance $d_{min}$ above the upper surface of the trampoline jumping surfaces. Typically, at least a portion of a given platform extends over (i) at least some springs used to fasten the trampoline jumping surface to the trampoline support structure, and (ii) a portion of the trampoline jumping surface.

In another exemplary embodiment, the trampoline systems of the present invention comprise a trampoline system comprising: two or more adjacent trampoline jumping surfaces with each trampoline jumping surface comprising at least one surface edge that faces a corresponding surface edge of an adjacent trampoline jumping surface; one or more vertically-extending frame members, each of said one or more vertically-extending frame members extending (i) between said at least one surface edge and said corresponding surface edge, and (ii) a distance $d_{fm}$ above upper surfaces of said two or more adjacent trampoline jumping surfaces; and one or more platforms supported by said one or more vertically-extending frame members, each platform having an upper platform surface and a lower platform surface, said lower platform surface being positioned at least a minimum distance $d_{min}$ above upper surfaces of said two or more adjacent trampoline jumping surfaces.

The present invention is further related to methods of making trampoline systems. In one exemplary embodiment, the method of making a trampoline system comprises: positioning one or more vertically-extending frame members between (1) at least one surface edge of a trampoline jumping surface and a support structure frame member of a trampoline support structure, and/or (2) two or more adjacent trampoline jumping surfaces so as to be between a surface edge and a corresponding surface edge on any two of the two or more adjacent trampoline jumping surfaces; and attaching one or more platforms to the one or more vertically-extending frame members, each platform having an upper platform surface and a lower platform surface, the lower platform surface being positioned at least a minimum distance $d_{min}$ above (1) an upper surface of the trampoline jumping surface and/or (2) the upper surfaces of the two or more adjacent trampoline jumping surfaces.

The present invention is even further related to methods of using trampoline systems. In one exemplary embodiment, the method of using a trampoline system comprises: (i) jumping from one of two or more adjacent trampoline jumping surfaces onto one or more platforms, (ii) jumping from the one or more platforms onto one of the two or more adjacent trampoline jumping surfaces, or (iii) both (i) and (ii), wherein each platform has an upper platform surface and a lower platform surface, the lower platform surface being positioned at least a minimum distance $d_{min}$ above upper surfaces of the two or more adjacent trampoline jumping surfaces.

These and other features and advantages of the present invention will become apparent after a review of the following detailed description of the disclosed embodiments and the appended claims.

DETAILED DESCRIPTION

Figure 1:
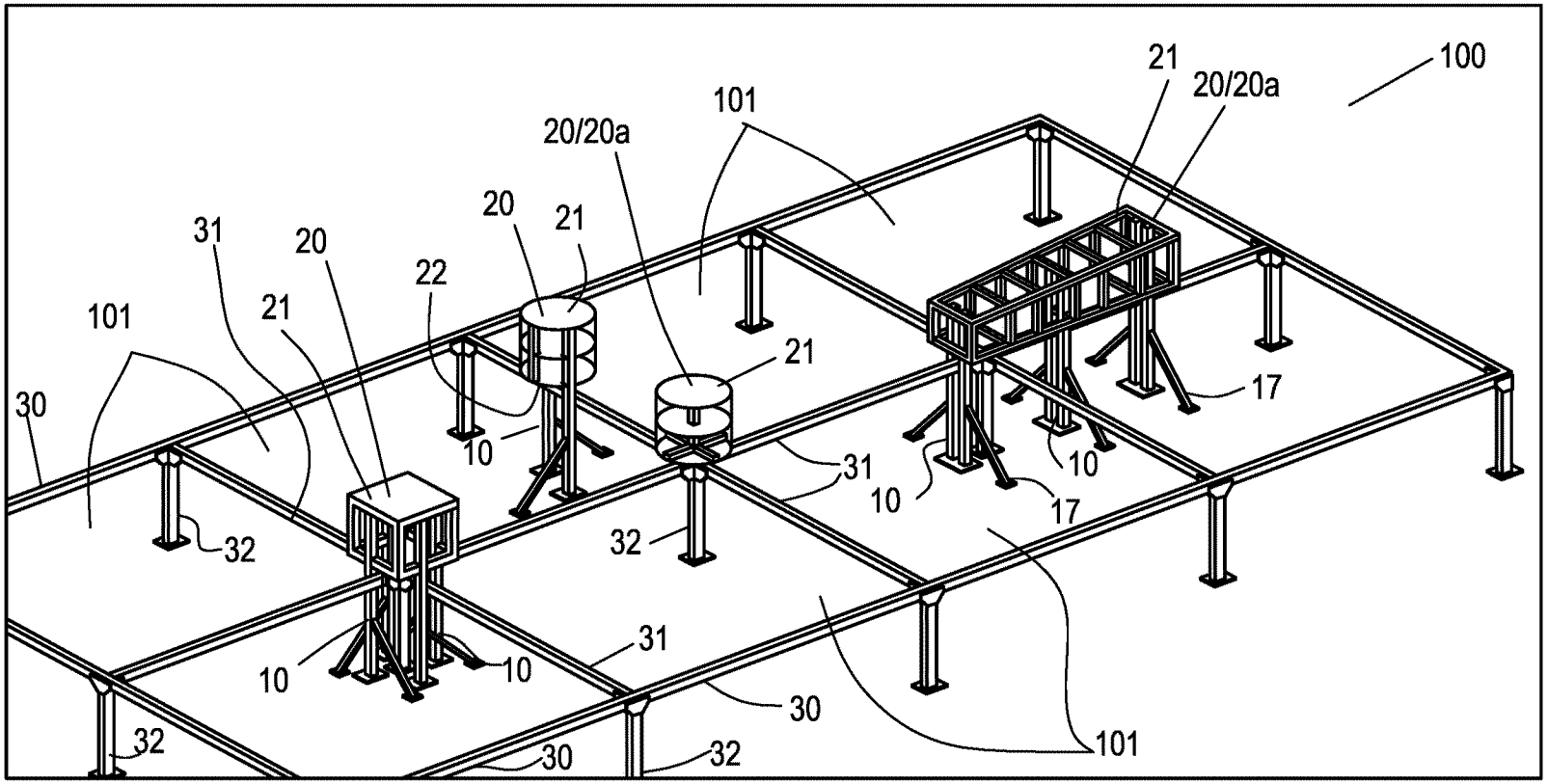
FIG. 1 is a perspective view of an exemplary trampoline system of the present invention.

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to trampoline systems. The present invention is further directed to methods of making trampoline systems. The present invention is even further directed to methods of using trampoline systems.

The trampoline systems of the present invention comprise: at least one platform 20 in combination with at least one trampoline jumping surface 101 with each trampoline jumping surface 101 comprising at least one surface edge 102 that faces the at least one platform 20; one or more vertically-extending frame members 10, each of the one or more vertically-extending frame members 10 extending (i) between the at least one surface edge 102 and a trampoline support structure 30 (i.e., support structure frame member 31 of trampoline support structure 30), and (ii) a distance $d_{fm}$ above an upper surface 104 of the trampoline jumping surface 101; and one or more platforms 20 supported by the one or more vertically-extending frame members 10, each platform 20 having an upper platform surface 21 and a lower platform surface 22, the lower platform surface 22 being positioned at least a minimum distance $d_{min}$ above the upper surface 104 of the trampoline jumping surfaces 101. Typically, at least a portion of platform 20 extends over (i) at least some springs (not shown) used to fasten the trampoline jumping surface 101 to the trampoline support structure 30, and (ii) a portion of the trampoline jumping surface 101. See, the figures.

Other Embodiments

Trampoline Systems

1. A trampoline system 100 comprising: two or more adjacent trampoline jumping surfaces 101 with each trampoline jumping surface 101 comprising at least one surface edge 102 that faces a corresponding surface edge 103 of an adjacent trampoline jumping surface 101; one or more vertically-extending frame members 10, each of said one or more vertically-extending frame members 10 extending (i) between said at least one surface edge 102 and said corresponding surface edge 103, and (ii) a distance $d_{fm}$ above upper surfaces 104 of said two or more adjacent trampoline jumping surfaces 101; and one or more platforms 20 supported by said one or more vertically-extending frame members 10, each platform 20 having an upper platform surface 21 and a lower platform surface 22, said lower platform surface 22 being positioned at least a minimum distance $d_{min}$ above upper surfaces 104 of said two or more adjacent trampoline jumping surfaces 101.

2. The trampoline system 100 of embodiment 1, wherein said lower platform surface 22 extends over at least one of said two or more adjacent trampoline jumping surfaces 101.

3. The trampoline system 100 of embodiment 1 or 2, wherein said lower platform surface 22 extends over said two or more adjacent trampoline jumping surfaces 101.

Figure 3:
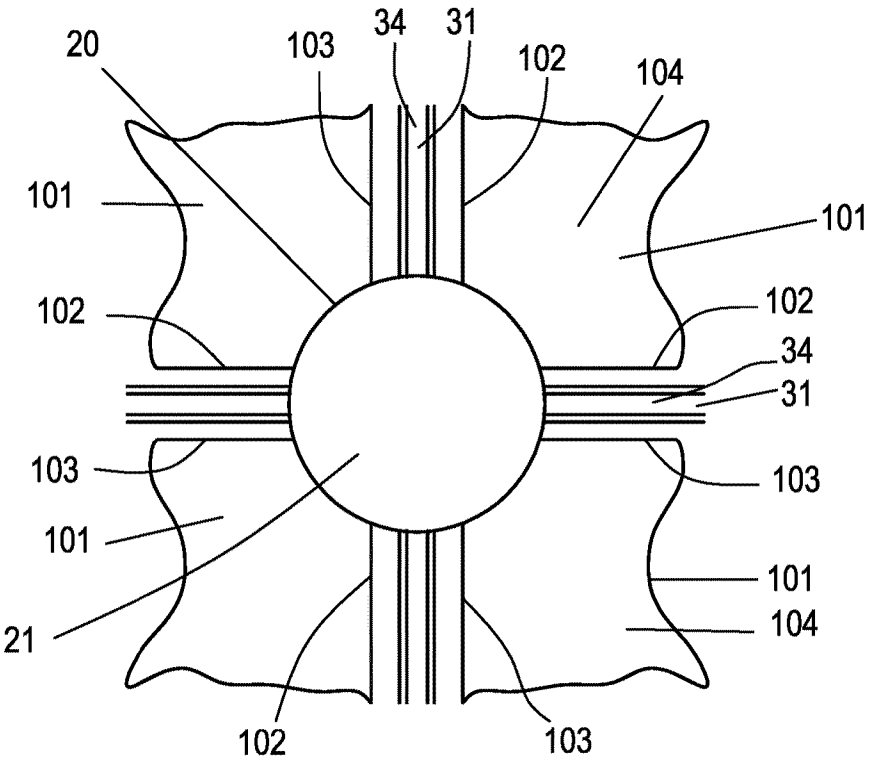
FIG. 3 is a top view of the exemplary platform shown in FIG. 2.

4. The trampoline system 100 of any one of embodiments 1 to 3, wherein a lower platform surface 22 of a single platform 20 extends over from 2 to 4 trampoline jumping surfaces 101. See, for example, single circular-shaped platform 20*a* shown in FIGS. 1-3.

5. The trampoline system 100 of any one of embodiments 1 to 4, further comprising: a trampoline support structure 30, said trampoline support structure 30 comprising a support structure frame member 31 extending between said at least one surface edge 102 and said corresponding surface edge 103, wherein each of said one or more vertically-extending frame members 10 extends a distance $d_{fm}$ above an upper surface 34 of said support structure frame member 31.

6. The trampoline system 100 of embodiment 5, wherein said lower platform surface 22 is positioned at least minimum distance $d_{min}$ above said upper surface 34 of said support structure frame member 31.

7. The trampoline system 100 of any one of embodiments 1 to 6, wherein minimum distance $d_{min}$ is equal to or greater than about 1.0 inch (in) (or any value, in increments of 0.1 in, greater than 1.0 in, e.g., 1.6 in, or any range of values, in increments of 0.1 in, greater than 1.0 in, e.g., from about 1.5 in to about 36.2 in).

8. The trampoline system 100 of any one of embodiments 1 to 7, wherein minimum distance $d_{min}$ is about 1.5 in to about 12.0 in.

9. The trampoline system 100 of any one of embodiments 1 to 8, wherein said upper platform surface 21 is positioned at least a maximum distance $d_{max}$ above upper surfaces 104 of said two or more adjacent trampoline jumping surfaces 101.

Figure 5:
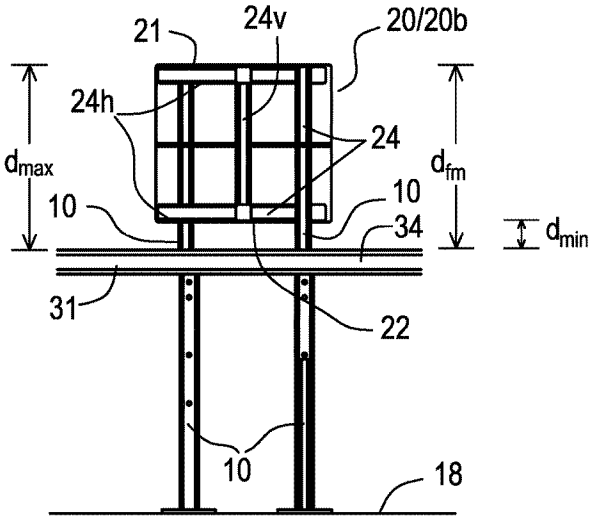
FIG. 5 is a side view of the exemplary platform shown in FIG. 4.
Figure 6:
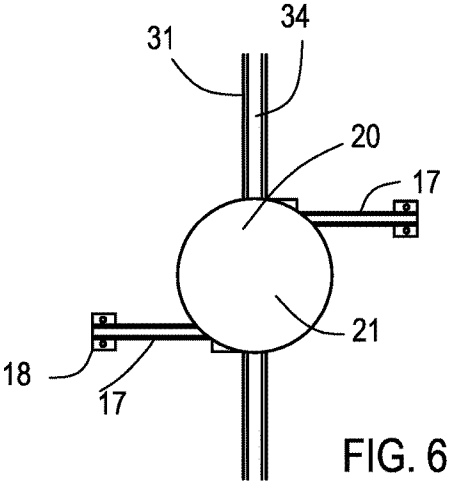
FIG. 6 is a top view of the exemplary platform shown in FIG. 4.
Figure 4:
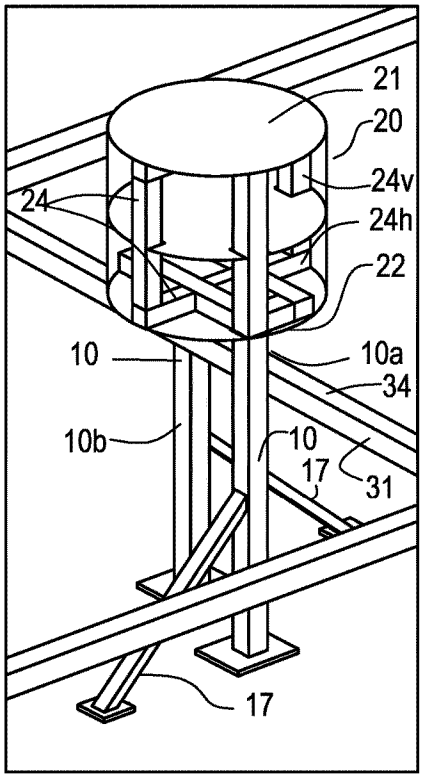
FIG. 4 is a perspective side view of another exemplary platform suitable for use in the trampoline systems of the present invention.
Figure 7:
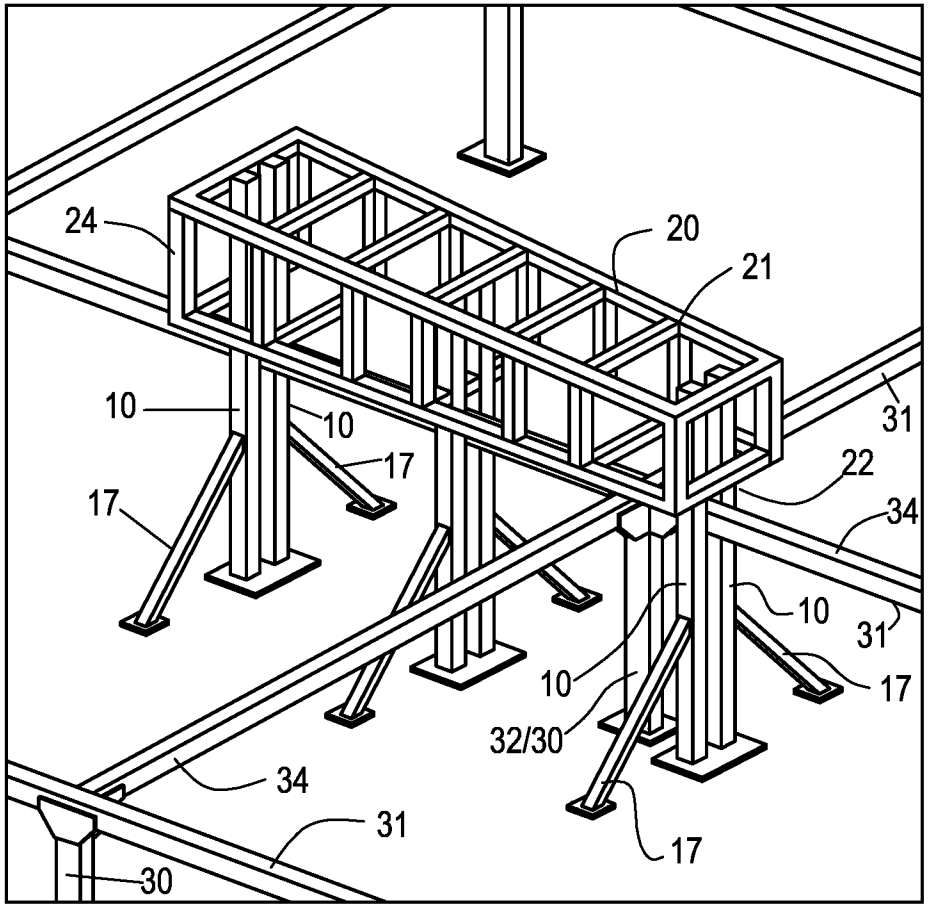
FIG. 7 is a perspective view of another exemplary platform suitable for use in the trampoline systems of the present invention.

10. The trampoline system 100 of any one of embodiments 1 to 9, wherein said upper platform surface 22 is substantially parallel with said lower platform surface 21 (i.e., within parallel planes relative to one another). See, for example, platform 20*b* shown in FIG. 5, wherein upper platform surface 22 is substantially parallel with lower platform surface 21.

Figure 8:
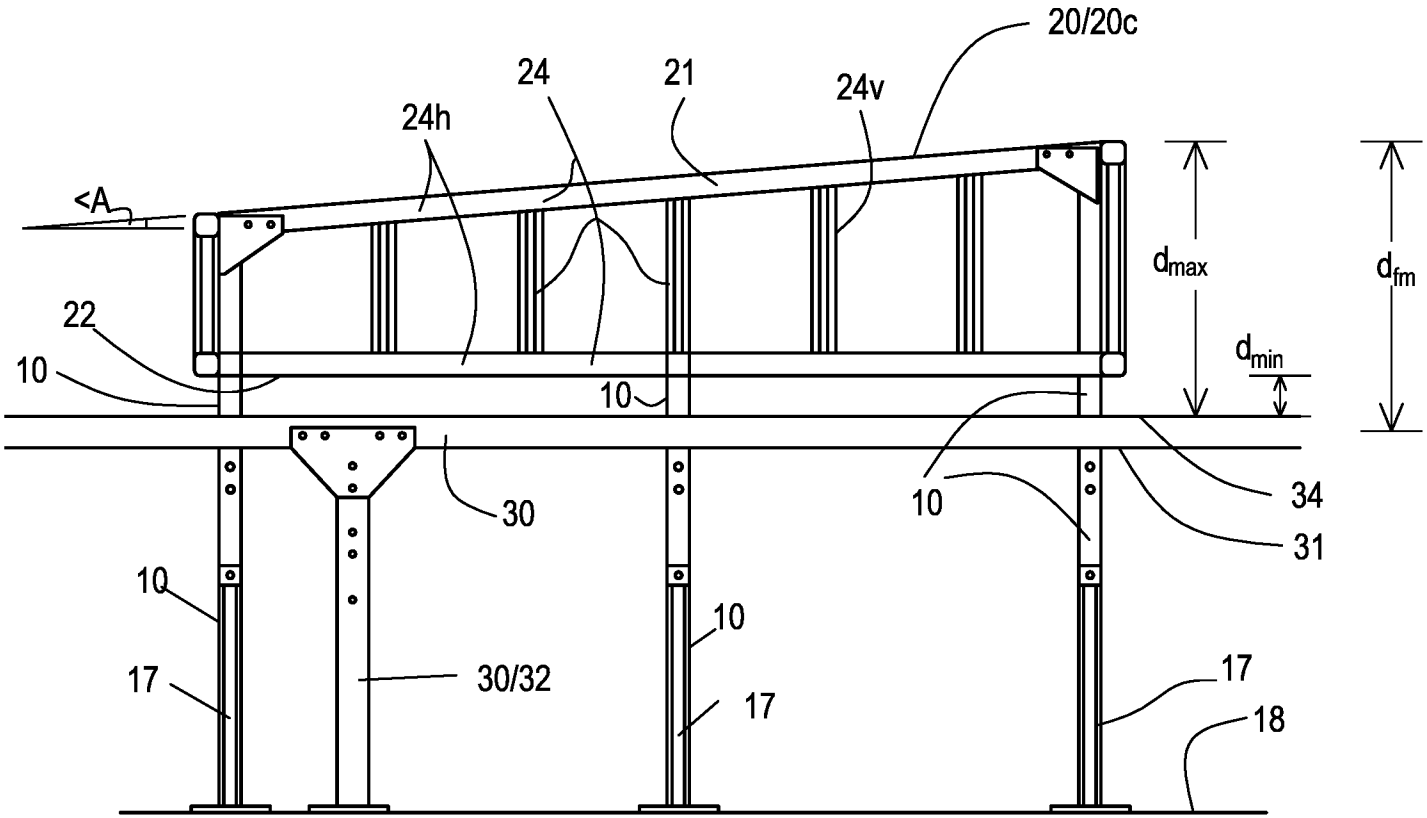
FIG. 8 is a side view of the exemplary platform shown in FIG. 7.
Figure 9:
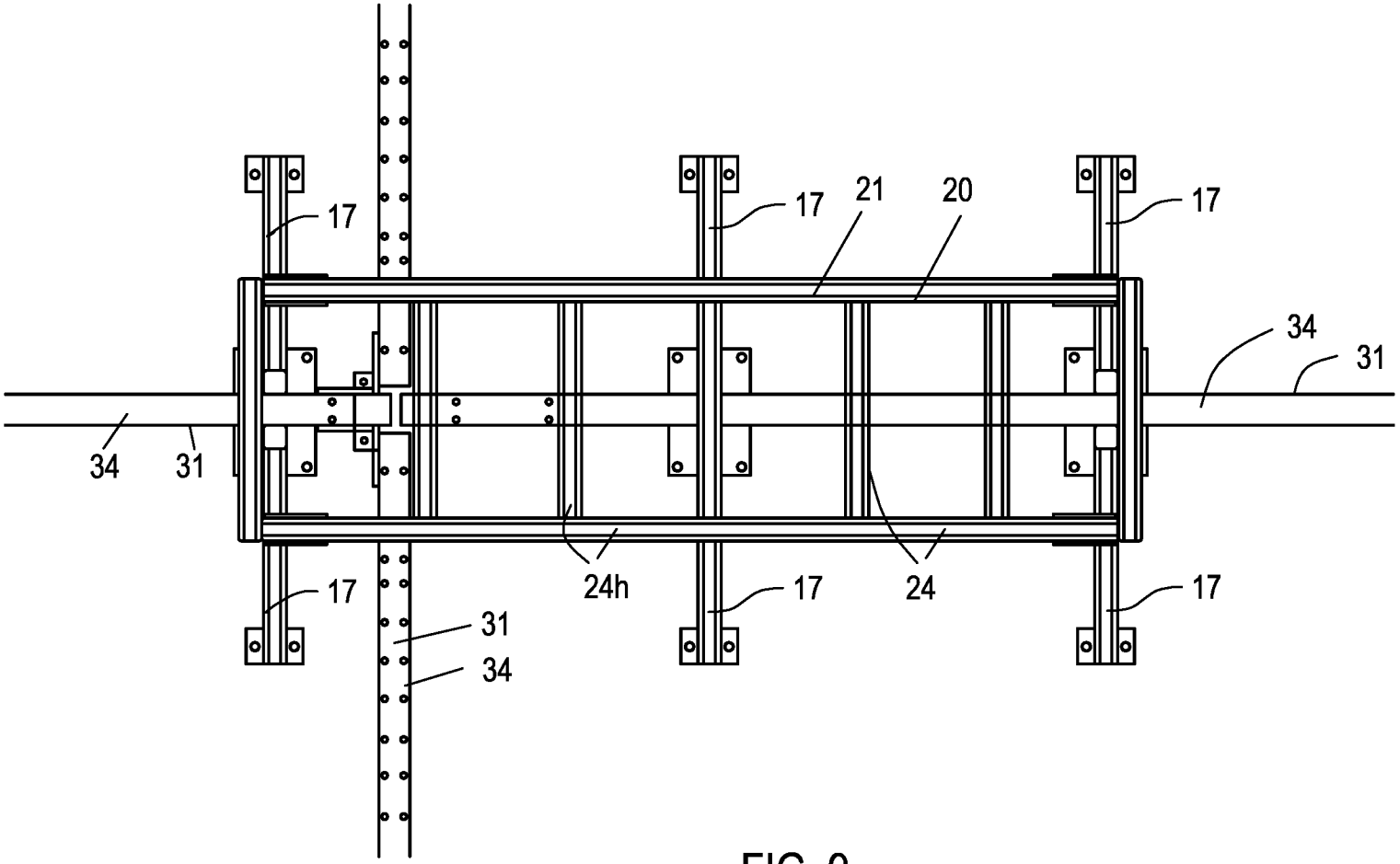
FIG. 9 is a top view of the exemplary platform shown in FIG. 7.

11. The trampoline system 100 of any one of embodiments 1 to 9, wherein said upper platform surface 21 is not parallel with said lower platform surface 22 (i.e., not within parallel planes relative to one another). See, for example, platform 20*c* shown in FIG. 8, wherein upper platform surface 22 is not parallel with lower platform surface 21.

12. The trampoline system 100 of any one of embodiments 1 to 8 or 11, wherein said upper platform surface 21 is at an angle A relative to said lower platform surface 22, angle A being less than about 45° (or any value, in increments of 0.1°, less than 45°, e.g., 4.2°, or any range of values, in increments of 0.1°, less than 45°, e.g., from about 0.8° to about 2.8°). See, for example, angle A shown in FIG. 8.

13. The trampoline system 100 of embodiment 12, wherein angle A ranges from about 5° to about 30°.

14. The trampoline system 100 of any one of embodiments 9 to 13, wherein maximum distance $d_{max}$ is equal to or less than about 72.0 in (or any value, in increments of 0.1 in, less than 72.0 in, e.g., 36.5 in, or any range of values, in increments of 0.1 in, less than 72.0 in, e.g., from about 12.3 in to about 36.2 in).

15. The trampoline system 100 of any one of embodiments 9 to 14, wherein maximum distance $d_{max}$ is about 3.0 in to about 36.0 in.

16. The trampoline system 100 of any one of embodiments 9 to 15, wherein said platform 20 further comprises one or more platform frame members 24 separating said lower platform surface 22 from said upper platform surface 21.

17. The trampoline system 100 of any one of embodiments 9 to 16, wherein said platform 20 further comprises one or more platform frame members 24 separating said lower platform surface 22 from said upper platform surface 21, said one or more platform frame members 24 comprising one or more horizontally-extending platform frame members 24*h*.

18. The trampoline system 100 of any one of embodiments 9 to 17, wherein said platform 20 further comprises one or more platform frame members 24 separating said lower platform surface 22 from said upper platform surface 21, said one or more platform frame members 24 comprising one or more vertically-extending platform frame members 24*v*.

19. The trampoline system 100 of embodiment 18, wherein at least one of said one or more vertically-extending platform frame members 24*v* is positioned above at least one of said two or more adjacent trampoline jumping surfaces 101.

20. The trampoline system 100 of embodiment 18 or 19, wherein each of said one or more vertically-extending platform frame members 24*v* is positioned above at least one of said two or more adjacent trampoline jumping surfaces 101.

21. The trampoline system 100 of any one of embodiments 1 to 20, wherein distance $d_{fm}$ is equal to or less than 72.0 in (or any value, in increments of 0.1 in, less than 72.0 in, e.g., 36.5 in, or any range of values, in increments of 0.1 in, less than 72.0 in, e.g., from about 12.3 in to about 36.2 in).

22. The trampoline system 100 of any one of embodiments 1 to 21, wherein distance $d_{fm}$ is about 12.0 in to about 36.0 in.

23. The trampoline system 100 of any one of embodiments 1 to 22, wherein at least one upper platform surface 21 has a circular shape. See, for example, exemplary platforms 20*a* and 20*b* shown in FIGS. 1-6.

24. The trampoline system 100 of any one of embodiments 1 to 23, wherein at least one upper platform surface 21 has a rectangular shape. See, for example, exemplary platform 20*c* shown in FIGS. 1 and 7-10.

25. The trampoline system 100 of any one of embodiments 1 to 24, wherein at least one upper platform surface 21 has a square shape.

26. The trampoline system 100 of any one of embodiments 1 to 25, wherein at least one upper platform surface 21 has an oval or diamond shape. It should be understood that the upper platform surface 21 may have any upper surface shape. Other possible upper surface shapes include, but are not limited to, a star shape, a triangular shape, a pentagon shape, a hexagon shape, an octagon shape, a figure-eight shape, and a rhombus shape.

Figure 2:
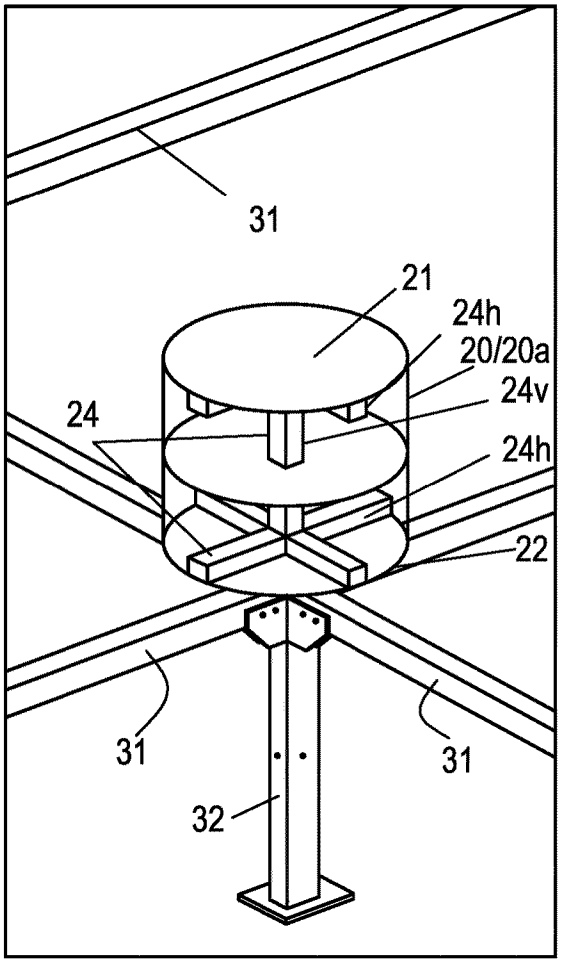
FIG. 2 is a perspective side view of an exemplary platform suitable for use in the trampoline systems of the present invention.
Figure 10:
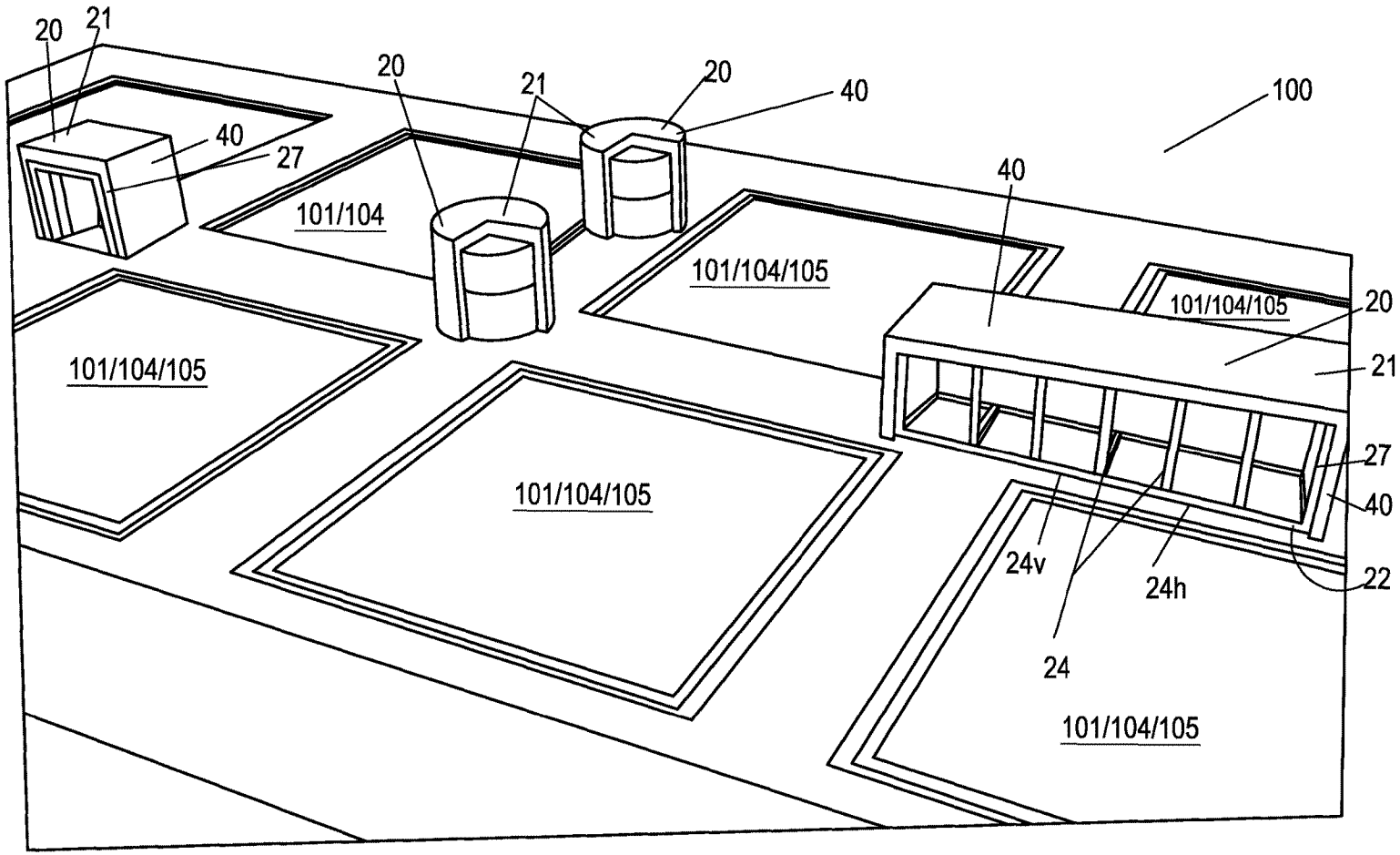
FIG. 10 is a perspective view of the exemplary trampoline system shown in FIG. 1 with trampoline mats and padding attached thereto.

27. The trampoline system 100 of any one of embodiments 1 to 26, wherein said one or more platforms 20 comprise from about 2 to about 100 platforms 100. As shown in FIGS. 1 and 10, exemplary trampoline system 100 comprises four separate platforms 20. It should be understood that a given trampoline system of the present invention may have any number of separate platforms 20.

28. The trampoline system 100 of any one of embodiments 1 to 27, wherein said trampoline system 100 comprising up to about 50 separate trampoline jumping surfaces 101.

29. The trampoline system 100 of any one of embodiments 5 to 28, wherein each of said one or more vertically-extending frame members 10 is adjacent to said support structure frame member 31.

30. The trampoline system 100 of any one of embodiments 5 to 29, wherein two or more vertically-extending frame members 10 are adjacent to and on opposite sides of said support structure frame member 31.

31. The trampoline system 100 of any one of embodiments 5 to 30, wherein one or more vertically-extending frame members 10 is attached to said support structure frame member 31.

32. The trampoline system 100 of any one of embodiments 5 to 31, wherein each of said one or more vertically-extending frame members 10 is attached to said support structure frame member 31.

33. The trampoline system 100 of any one of embodiments 5 to 32, wherein one or more vertically-extending frame members 10 is integrally connected to said support structure frame member 31. See, for example, vertically-extending frame member 10 integrally connected to support structure frame member 31 in FIG. 2.

34. The trampoline system 100 of any one of embodiments 1 to 33, wherein one or more vertically-extending frame members 10 further comprise a brace member 17 operatively adapted to brace a given vertically-extending frame member 17 to a base substrate 18 (e.g., the floor).

35. The trampoline system 100 of any one of embodiments 1 to 34, wherein one or more vertically-extending frame members 10 comprise upper and lower vertically-extending frame members $\mathbf{10}_L$ and $\mathbf{10}_U$ that engage with one another, said upper and lower vertically-extending frame members $\mathbf{10}_L$ and $\mathbf{10}_U$ being configured so as to adjust (i.e., increase or decrease) an overall height of a given vertically-extending frame member 10.

36. The trampoline system 100 of embodiment 35, wherein said upper and lower vertically-extending frame members $\mathbf{10}_L$ and $\mathbf{10}_U$ are engaged with one another via a locking member (e.g., a pin)(not shown).

37. The trampoline system 100 of any one of embodiments 5 to 36, wherein said trampoline support structure 30 further comprises one or more vertically-extending support structure frame members 32, said one or more vertically-extending support structure frame members 32 supporting and being connected to said support structure frame member 31.

38. The trampoline system 100 of any one of embodiments 1 to 37, wherein each of said two or more adjacent trampoline jumping surfaces 101 comprises a separate fabric material 105. See, for example, FIG. 10. Although any trampoline material may be used, each trampoline jumping surface 101 is typically an upper surface of a woven polypropylene trampoline fabric.

39. The trampoline system 100 of embodiment 38, wherein said trampoline system 100 further comprises a plurality of elastic members (not shown), said plurality of elastic members connecting said separate fabric material 105 to said support structure frame member 31.

40. The trampoline system 100 of embodiment 39, wherein said plurality of elastic members comprises a plurality of springs (not shown).

41. The trampoline system 100 of any one of embodiments 1 to 40, wherein said lower platform surface 22 is substantially planar to said two or more adjacent trampoline jumping surfaces 101 (i.e., within parallel planes relative to one another).

42. The trampoline system 100 of any one of embodiments 1 to 41, wherein said upper platform surface 21 has an upper surface area of at least 16 square inches ($in^2$) up to about 400 square feet ($ft^2$). Typically, a given platform 20 has an upper surface area that is proportional to an upper surface area of an adjacent trampoline jumping surface 101. For example, a trampoline jumping surface 101 having an overall length of 10 ft may have a platform 20 positioned adjacent thereto, wherein the platform 20 has an upper surface area ranging from about 1.0 $ft^2$ to about 30 $ft^2$. For a trampoline jumping surface 101 having an overall length of 130 ft, a platform 20 positioned adjacent thereto might have an upper surface area ranging from about 1.0 $ft^2$ to about 390 $ft^2$.

43. The trampoline system 100 of any one of embodiments 1 to 42, wherein said upper platform surface 21 has an upper surface area of from about 1.0 $ft^2$ to about 12.0 $ft^2$.

44. The trampoline system 100 of any one of embodiments 1 to 43, wherein no portion of said one or more platforms 20 comes into contact with said two or more adjacent trampoline jumping surfaces 101.

45. The trampoline system 100 of any one of embodiments 1 to 44, wherein at least a portion of each of said one or more platforms 20 extends over at least some springs (not shown) used to fasten said two or more adjacent trampoline jumping surfaces 101 to a trampoline support structure 30.

46. The trampoline system 100 of any one of embodiments 1 to 45, wherein at least a portion of each of said one or more platforms 20 is covered with padding material.

47. The trampoline system 100 of any one of embodiments 1 to 46, wherein at least a portion of each of said one or more platforms 20 is covered with padding material comprising foam material. For example, the foam material may have a thickness of from about 1.0 in to about 5.0 in, more typically, from about 1.5 in to about 3.0 in.

48. The trampoline system 100 of any one of embodiments 1 to 47, wherein at least a portion of each of said one or more platforms 20 is covered with plywood.

49. The trampoline system 100 of any one of embodiments 1 to 48, wherein at least a portion of each of said one or more platforms 20 is covered with fabric material.

50. The trampoline system 100 of any one of embodiments 1 to 49, wherein at least a portion of each of said one or more platforms 20 is covered with polyvinyl chloride (PVC) fabric material.

51. The trampoline system 100 of any one of embodiments 1 to 50, further comprising at least one existing pad extending over springs (not shown) used to fasten said two or more adjacent trampoline jumping surfaces 101 to a trampoline support structure 30, said at least one existing pad comprising a hole therethrough, said hole being sized to enable said one or more vertically-extending frame members 10 to extend therethrough. For example, when retrofitting an existing trampoline system, one could cut one or more holes in an existing pad and assemble one or more platforms 20 of the present invention for use in combination with the existing trampoline system.

52. A trampoline system 100 comprising: at least one platform 20 in combination with at least one trampoline jumping surface 101 with each trampoline jumping surface 101 comprising at least one surface edge 102 that faces said at least one platform 20; one or more vertically-extending frame members 10, each of said one or more vertically-extending frame members 10 extending (i) between said at least one surface edge 102 and a support structure frame member 31 of a trampoline support structure 30, and (ii) a distance $d_{fm}$ above an upper surface 104 of said trampoline jumping surface 101; and one or more platforms 20 supported by said one or more vertically-extending frame members 10, each platform 20 having an upper platform surface 21 and a lower platform surface 22, said lower platform surface 22 being positioned at least a minimum distance $d_{min}$ above said upper surface 104 of said trampoline jumping surfaces 101.

53. The trampoline system 100 of embodiment 52, further comprising any of the features described in any one of embodiments 1 to 51.

Methods of Making Trampoline Systems

54. A method of making the trampoline system 100 of any one of embodiments 1 to 53, said method comprising: positioning the one or more vertically-extending frame members 10 between (1) at least one surface edge 102 of a trampoline jumping surface 101 and a support structure frame member 31 of a trampoline support structure 30, and/or (2) the at least one surface edge 102 and the corresponding surface edge 103; and attaching the one or more platforms 20 to the one or more vertically-extending frame members 10.

55. The method of embodiment 54, further comprising: attaching the one or more vertically-extending frame members 10 to a support structure frame member 31 of a trampoline support structure 30.

56. The method of embodiment 54 or 55, further comprising: adjusting an overall height of the one or more vertically-extending frame members 10.

57. The method of any one of embodiments 54 to 56, further comprising: attaching a padded surface member 40 onto an upper portion of one or more platform frame members 24 so as to form the upper platform surface 21.

58. The method of any one of embodiments 54 to 57, further comprising: covering one or more outer side surfaces 27 of one or more platform frame members 24 with at least one padded surface member 40.

59. The method of any one of embodiments 54 to 58, further comprising: positioning at least one padded surface member 40 between said lower platform surface 22 and at least one of said two or more adjacent trampoline jumping surfaces 101.

60. The method of any one of embodiments 54 to 59, further comprising: covering one or more outer surfaces 27 of one or more platform frame members 24 with plywood.

61. The method of any one of embodiments 54 to 60, further comprising: covering one or more outer surfaces 27 of one or more platform frame members 24 with fabric material.

62. The method of any one of embodiments 54 to 61, further comprising: covering one or more outer surfaces 27 of one or more platform frame members 24 with fabric material comprising polyvinyl chloride (PVC) fabric material.

63. The method of any one of embodiments 54 to 62, further comprising: cutting one or more holes within an existing pad extending over springs (not shown) used to fasten the two or more adjacent trampoline jumping surfaces 101 to a trampoline support structure 30, the one or more holes being sized to enable the one or more vertically-extending frame members 10 to extend therethrough.

64. The method of embodiment 63, further comprising: positioning one or more vertically-extending frame members 10 through the one or more holes within the existing pad.

Methods of Using Trampoline Systems

65. A method of using the trampoline system 100 of any one of embodiments 1 to 53, said method comprising: (i) jumping from one of the two or more adjacent trampoline jumping surfaces 101 onto the one or more platforms 20, (ii) jumping from the one or more platforms 20 onto one of the two or more adjacent trampoline jumping surfaces 101, or (iii) both (i) and (ii).

It should be understood that although the above-described trampoline systems, and methods are described as "comprising" one or more components or steps, the above-described trampoline systems, and methods may "comprise," "consists of," or "consist essentially of" any of the above-described components or steps of the trampoline systems, and methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a trampoline system and/or method that "comprises" a list of elements (e.g., components or steps) is not necessarily limited to only those elements (or components or steps), but may include other elements (or components or steps) not expressly listed or inherent to the trampoline system and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a protective trampoline system and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described trampoline systems and/or methods may comprise, consist essentially of, or consist of any of the herein-described components and features, as shown in the figures with or without any feature(s) not shown in the figures. In other words, in some embodiments, the trampoline systems and/or methods of the present invention do not have any additional features other than those shown in the figures, and such additional features, not shown in the figures, are specifically excluded from the trampoline systems and/or methods. In other embodiments, the trampoline systems and/or methods of the present invention do have one or more additional features that are not shown in the figures.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

Example 1

Trampoline systems, similar to exemplary trampoline system 100 shown in FIGS. 1-10, were prepared.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A trampoline system comprising:

two adjacent trampoline jumping surfaces with each trampoline jumping surface comprising a surface edge that faces a corresponding surface edge of an adjacent trampoline jumping surface;

one or plural vertically-extending frame members, each of said one or plural vertically-extending frame members extending (i) between said surface edge and said corresponding surface edge, and (ii) a distance $d_{fm}$ above upper surfaces of said two adjacent trampoline jumping surfaces; and one or plural platforms supported by said one or plural vertically-extending frame members, each platform having an upper platform surface and a lower platform surface, said lower platform surface being positioned a minimum distance $d_{min}$ above said upper surfaces of said two adjacent trampoline jumping surfaces, wherein a portion of said lower platform surface of each of said one or plural platforms is configured to extend over springs used to fasten said two adjacent trampoline jumping surfaces to a trampoline support structure.

2. The trampoline system of claim 1, wherein said lower platform surface extends over said two adjacent trampoline jumping surfaces.

3. The trampoline system of claim 1, wherein said lower platform surface of a single platform surface extends over from 2 to 4 trampoline jumping surfaces.

4. The trampoline system of claim 1, further comprising:

said trampoline support structure comprising a horizontally-extending support structure frame member extending between and along said surface edge and said corresponding surface edge, wherein each of said one or plural vertically-extending frame members extends said distance $d_{fm}$ above an upper surface of said support structure frame member, and said lower platform surface is positioned said minimum distance $d_{min}$ above said upper surface of said support structure frame member.

5. The trampoline system of claim 4, wherein said one or plural vertically-extending frame members comprises two vertically-extending frame members, and said two vertically-extending frame members are adjacent to and on opposite sides of said horizontally-extending support structure frame member.

6. The trampoline system of claim 1, wherein said minimum distance $d_{min}$ is about 1.5 in to about 12.0 in.

7. The trampoline system of claim 1, wherein said upper platform surface is substantially parallel with said lower platform surface.

8. The trampoline system of claim 1, wherein said upper platform surface is not parallel with said lower platform surface.

9. The trampoline system of claim 1, wherein said upper platform surface is at an angle A relative to said lower platform surface, said angle A being less than about 45°.

10. The trampoline system of claim 1, wherein said each platform further comprises one or plural platform frame members separating said lower platform surface from said upper platform surface, said one or plural platform frame members comprising one or plural vertically-extending platform frame members.

11. The trampoline system of claim 1, wherein said distance $d_{fm}$ is about 12.0 in to about 36.0 in.

12. The trampoline system of claim 1, wherein said upper platform surface has a circular shape.

13. The trampoline system of claim 1, wherein said upper platform surface has a rectangular shape or a square shape.

14. The trampoline system of claim 1, wherein said one or plural platforms comprise from about 2 to about 100 platforms, and said trampoline system comprises up to about 50 separate trampoline jumping surfaces.

15. The trampoline system of claim 1, wherein one or plural vertically-extending frame members comprise upper and lower vertically-extending frame members that engage with one another, said upper and lower vertically-extending frame members being configured so as to adjust an overall height of a given vertically-extending frame member.

16. The trampoline system of claim 1, further comprising one or plural existing pads extending over said springs used to fasten said two adjacent trampoline jumping surfaces to said trampoline support structure, said one or plural existing pads comprising a hole therethrough, said hole being sized to enable said one or plural vertically-extending frame members to extend therethrough.

17. A method of using the trampoline system of claim 1, said method comprising:

(i) jumping from one of the two adjacent trampoline jumping surfaces onto the one or plural platforms, (ii) jumping from the one or plural platforms onto one of the two adjacent trampoline jumping surfaces, or (iii) both (i) and (ii).

18. A trampoline system comprising:

one or plural platforms in combination with a trampoline jumping surface with the trampoline jumping surface comprising a surface edge that faces said one or plural platforms;

one or plural vertically extending frame members, each of said one or plural vertically-extending frame members extending (i) between said surface edge and a horizontally-extending support structure frame member of a trampoline support structure, (ii) between adjacent springs used to fasten said surface edge to said horizontally-extending support structure frame member, and (iii) a distance $d_{fm}$ above an upper surface of said trampoline jumping surface; and said one or plural platforms being supported by said one or plural vertically-extending frame members, each platform having an upper platform surface and a lower platform surface, said lower platform surface being positioned a minimum distance $d_{min}$ above said upper surface of said trampoline jumping surface.

19. The trampoline system of claim 18, wherein said one or plural vertically-extending frame members comprises two vertically-extending frame members that are adjacent to and on opposite sides of said horizontally-extending support structure frame member.

20. The trampoline system of claim 18, wherein a portion of said lower platform surface of each of said one or plural platforms extends over said adjacent springs.

* * * * *